US010281866B2

(12) United States Patent
Okamoto et al.

(10) Patent No.: US 10,281,866 B2
(45) Date of Patent: May 7, 2019

(54) IMAGE FORMING APPARATUS AND PROCESS CARTRIDGE

(71) Applicants: Michiya Okamoto, Kanagawa (JP); Nobuyuki Taguchi, Kanagawa (JP); Takeshi Fukao, Kanagawa (JP); Shinya Karasawa, Kanagawa (JP); Takuma Iwasaki, Tokyo (JP); Kentaro Nodera, Kanagawa (JP); Masanari Shimamoto, Kanagawa (JP)

(72) Inventors: Michiya Okamoto, Kanagawa (JP); Nobuyuki Taguchi, Kanagawa (JP); Takeshi Fukao, Kanagawa (JP); Shinya Karasawa, Kanagawa (JP); Takuma Iwasaki, Tokyo (JP); Kentaro Nodera, Kanagawa (JP); Masanari Shimamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/785,518

(22) Filed: Oct. 17, 2017

(65) Prior Publication Data

US 2018/0113411 A1 Apr. 26, 2018

(30) Foreign Application Priority Data

Oct. 25, 2016 (JP) ..... 2016-208596

(51) Int. Cl.

| | |
|---|---|
| ***G03G 15/00*** | (2006.01) |
| ***G03G 15/04*** | (2006.01) |
| ***G03G 21/18*** | (2006.01) |

(52) U.S. Cl.
CPC ..... *G03G 15/75* (2013.01); *G03G 15/04054* (2013.01); *G03G 21/1821* (2013.01)

(58) Field of Classification Search
CPC ..... G03G 15/04; G03G 15/11; G03G 15/75; G03G 15/04036; G03G 15/04045;
(Continued)

(56) References Cited

U.S. PATENT DOCUMENTS 5,485,190 A * 1/1996 Koetter ..... B41J 2/45 347/130
7,042,591 B1 * 5/2006 Yamazaki ..... G03G 15/326 358/1.5

(Continued)

FOREIGN PATENT DOCUMENTS

| | | |
|---|---|---|
| JP | 2002-361931 | 12/2002 |
| JP | 2007-076031 | 3/2007 |
| JP | 2016-022716 | 2/2016 |

*Primary Examiner* — David M. Gray
*Assistant Examiner* — Andrew V Do
(74) *Attorney, Agent, or Firm* — Harness, Dickey & Pierce, P.L.C.

(57) ABSTRACT

An image forming apparatus includes a rotatable image bearer, an exposure device, a development unit, an adjuster, and a magnetic member. The exposure device forms a latent image on a surface of the image bearer. The developing unit renders the latent image visible with developer including toner and carrier. The adjuster contacts each of the image bearer and the exposure device to regulate a distance between the image bearer and the exposure device. The magnetic member is arranged side by side with the adjuster in a direction of rotation of the image bearer.

20 Claims, 7 Drawing Sheets

(58) Field of Classification Search
CPC ..... G03G 15/04054; G03G 15/04063; G03G 15/04072; G03G 2215/0402; G03G 2215/0404; G03G 2215/0407; G03G 2215/0409; G03G 2215/0412; G03G 2215/0417
See application file for complete search history.

(56) References Cited

U.S. PATENT DOCUMENTS

| | | | | |
|---|---|---|---|---|
| 2013/0243478 | A1 | 9/2013 | Okamoto et al. | |
| 2015/0035928 | A1* | 2/2015 | Nakamura ..... | G03G 15/04 347/118 |
| 2015/0160587 | A1 | 6/2015 | Seki et al. | |
| 2015/0248075 | A1 | 9/2015 | Seki et al. | |
| 2016/0026111 | A1 | 1/2016 | Arasawa et al. | |
| 2016/0179027 | A1 | 6/2016 | Seki et al. | |
| 2016/0195830 | A1 | 7/2016 | Seki et al. | |

* cited by examiner

IMAGE FORMING APPARATUS AND PROCESS CARTRIDGE

CROSS-REFERENCE TO RELATED APPLICATION

This patent application is based on and claims priority pursuant to 35 U.S.C. § 119 to Japanese Patent Application No. 2016-208596, filed on Oct. 25, 2016, in the Japan Patent Office, the entire disclosure of which is hereby incorporated by reference herein.

BACKGROUND

Technical Field

Exemplary aspects of the present disclosure relate to an image forming apparatus and a process cartridge.

Related Art

Conventionally, image forming apparatuses including a rotatable image bearer, an exposure device, a developing device, and an adjuster are known. The exposure device forms a latent image on a surface of the image bearer. The developing device renders the latent image visible. The adjuster contacts each of the image bearer and the exposure device to regulate a distance between the image bearer and the exposure device.

For example, an image forming apparatus using a spacer as an adjuster has been proposed. The spacer has a curvature contact surface that contacts a photoconductor as an image bearer.

SUMMARY

In at least one embodiment of this disclosure, there is provided an improved image forming apparatus that includes a rotatable image bearer, an exposure device, a development unit, an adjuster, and a magnetic member. The exposure device forms a latent image on a surface of the image bearer. The developing unit renders the latent image visible with developer including toner and carrier. The adjuster contacts each of the image bearer and the exposure device to regulate a distance between the image bearer and the exposure device. The magnetic member is arranged side by side with the adjuster in a direction of rotation of the image bearer.

Further provided is an improved process cartridge that is usable in an image forming apparatus including a rotatable image bearer, an exposure device, a developing unit, an adjuster, and a magnetic member. The exposure device forms a latent image on a surface of the image bearer. The developing unit renders the latent image visible. The adjuster contacts each of the image bearer and the exposure device to regulate a distance between the image bearer and the exposure device. The magnetic member is arranged side by side with the adjuster in a direction of rotation of the image bearer. The process cartridge includes at least the image bearer and the magnetic member as a single unit, and is detachable from the image forming apparatus.

Further provided is an improved image forming apparatus that includes the process cartridge described above.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
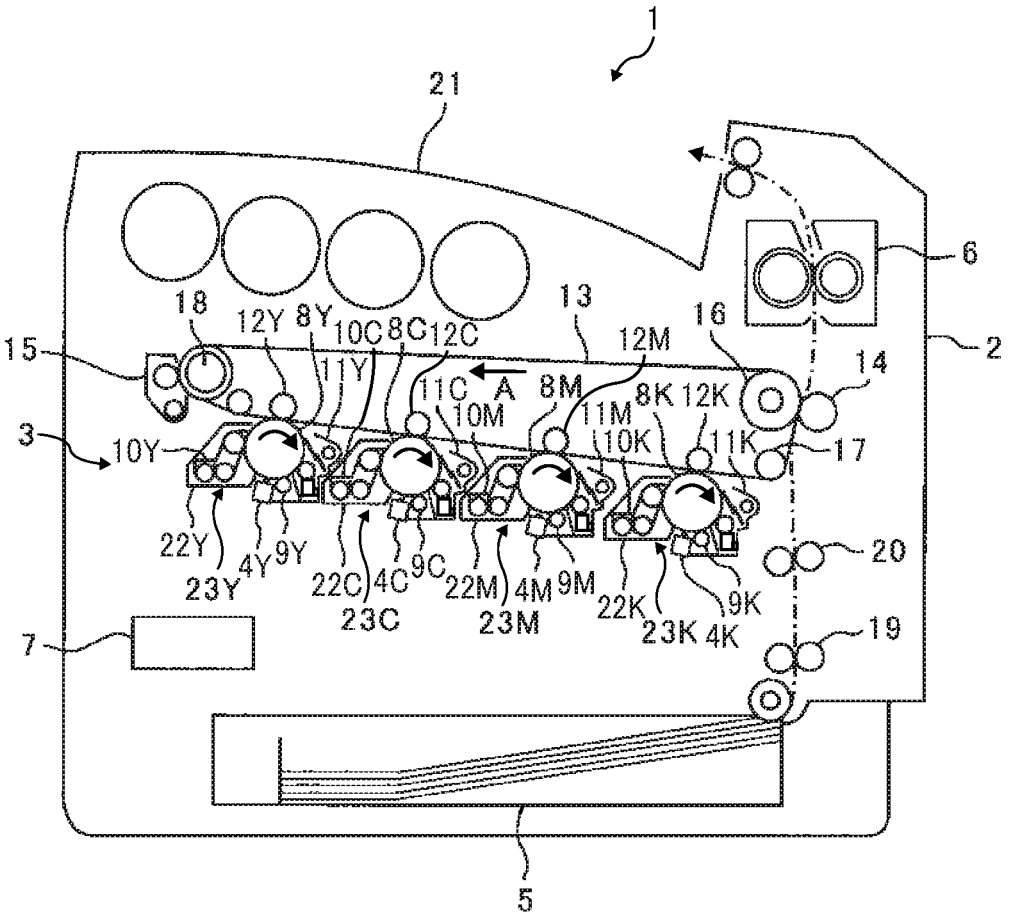
FIG. 1 is a schematic diagram illustrating a printer as one example of an image forming apparatus according to an exemplary embodiment.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

Hereinafter, a color printer 1 as an electrophotographic image forming apparatus according to an exemplary embodiment is described with reference to the drawings. First, a configuration of the color printer 1 as one example of an image forming apparatus is described with reference to FIG. 1. The color printer 1 includes an apparatus body case 2 in which a printer engine 3, an optical writing device 4 for emitting an optical beam, and a sheet feeding cassette 5 as a recording medium storage unit for storing a recoding medium P as a transfer receiving member are arranged. Moreover, the apparatus body case 2 includes a fixing device 6 for fixing a toner image transferred to a recording medium P, and a waste toner container 7 in which waste toner generated after transfer of the toner image is collected.

The printer engine 3 forms a toner image, and transfers the toner image to a recording medium P. The printer engine 3 includes four photoconductors 8Y, 8C, 8M, and 8K as image bearers, charging rollers 9Y, 9C, 9M, and 9K as chargers, developing devices 10Y, 10C, 10M, and 10K, cleaning devices 11Y, 11C, 11M, and 11K, primary transfer rollers 12Y, 12C, 12M, and 12K, an intermediate transfer belt 13, a secondary transfer roller 14 as a transfer unit, and a cleaning device 15. The charging rollers 9Y, 9C, 9M, and 9K, the developing devices 10Y, 10C, 10M, and 10K, and the cleaning devices 11Y, 11C, 11M, and 11K are arranged around the respective photoconductors 8Y, 8C, 8M, and 8K. The suffixes Y, C, M, and K to the numerical values respectively indicate yellow, cyan, magenta, and black. In this patent specification and the drawings, since each of components with the suffixes Y, C, M, and K is substantially similar to every other except for the color of a toner image to be formed, such suffixes can be omitted.

The photoconductor 8 is formed in cylindrical shape and connected to a drive motor. The photoconductor 8 is rotated around a center line by a driving force from the drive motor. The photoconductor 8 includes an outer circumferential surface with a photoconductive layer on which an electrostatic latent image is to be formed. The charging roller 9 as a charger is disposed on the outer circumferential surface of the photoconductor 8. When a voltage is applied to the charging roller 9 from a power source, the outer circumferential surface of the photoconductor 8 is uniformly charged. The optical writing device 4 emits an optical beam according to image data to irradiate the uniformly charged outer circumferential surface of the photoconductor 8 with the optical beam. Such irradiation forms an electrostatic latent image on the outer circumferential surface of the photoconductor 8 according to the image data. A developing device 10 as a developing unit supplies toner to the photoconductor 8. The supplied toner adheres to the electrostatic latent image formed on the outer circumferential surface of the photoconductor 8, so that the electrostatic latent image on the photoconductor 8 is rendered visible as a toner image.

The intermediate transfer belt 13 as a looped belt includes a base made of resin film or rubber. The intermediate transfer belt 13 is looped around a drive roller 16, an inlet roller 17, and a tension roller 18. The intermediate transfer belt 13 is rotated in a direction indicated by an arrow A illustrated in FIG. 1 by rotation of the drive roller 16 connected to a drive motor. Each of the inlet roller 17 and the tension roller 18 is rotated using a friction force generated with the intermediate transfer belt 13 by rotation of the intermediate transfer belt 13 in the direction A. The primary transfer roller 12 is disposed on an inner circumferential surface (inside the loop) of the intermediate transfer belt 13. When a transfer voltage is applied to each of the primary transfer rollers 12, a toner image on each of the photoconductors 8 is transferred to the intermediate transfer belt 13. The toner images on the photoconductors 8 are sequentially transferred to and overlapped on the intermediate transfer belt 13, thereby forming a color toner image on the intermediate transfer belt 13.

The cleaning device 11 cleans the outer circumferential surface of the photoconductor 8 after the toner image is transferred to the intermediate transfer belt 13. After transfer of the toner image to the intermediate transfer belt 13, paper dust and residual toner remaining on the outer circumferential surface of the photoconductor 8 are collected as waste toner.

The color toner image formed on the intermediate transfer belt 13 is transferred to a recording medium P by using a transfer voltage applied to the secondary transfer roller 14 when the recording medium P is fed to a transfer position in which the intermediate transfer belt 13 and the secondary transfer roller 14 contact each other. The recording medium P is fed from the sheet feeding cassette 5 and then conveyed by a conveyance roller 19 and a registration roller 20. The recording medium P is fed to the fixing device 6 after the toner image is transferred to the recording medium P. In a fixing process, the fixing device 6 applies heat and pressure to the recording medium P with the transferred toner image, so that the fused toner image is fixed on the recording medium P. After the fixing process, the recording medium P is ejected to an ejection tray 21 disposed on a top portion of the apparatus body case 2.

The cleaning device 15 cleans an outer circumferential surface of the intermediate transfer belt 13 after the color toner image is transferred to the recording medium P. Accordingly, for example, paper dust and residual toner remaining on the outer circumferential surface of the intermediate transfer belt 13 after transfer of the toner image are collected as waste toner. The waste toner container 7 stores the waste toner collected by the cleaning devices 11 and 15. Moreover, the waste toner container 7 is detachable from the apparatus body case 2. When the waste toner container 7 becomes almost full of the waste toner, the waste toner container 7 is detached from the apparatus body case 2 and an empty waste toner container 7 is attached.

The photoconductor 8 as a member of the printer engine 3, the developing device 10, and the cleaning device 11 are formed as a unit and stored in a case 22 to form a process cartridge 23 (i.e., each of the process cartridges 23Y, 23C, 23M, and 23K). Each of the process cartridges 23 is detachably disposed inside the apparatus body case 2. Since the photoconductor 8, the developing device 10, and the cleaning device 11 are formed as the process cartridge 23, replacement and maintenance work are facilitated. Moreover, positional accuracy between the members can be maintained with high accuracy, and quality of an image to be formed can be enhanced.

The exemplary embodiment has been described using an example case in which the photoconductor 8, the developing device 10, and the cleaning device 11 are formed as the process cartridge 23. However, a process cartridge of the exemplary embodiment is not limited thereto. There may be various configurations of process cartridges. For example, the photoconductor 8 and at least one of the charging roller 9, the developing device 10, and the cleaning device 11 may be stored inside the case 22 and formed as a unit.

Figure 2:
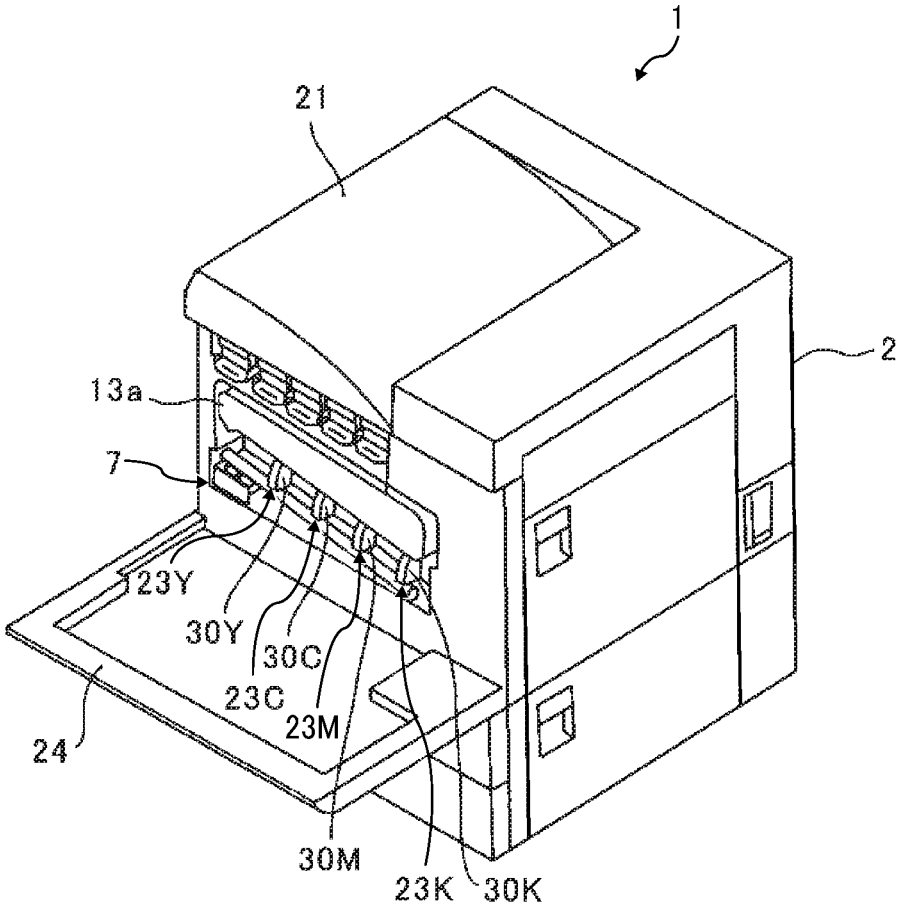
FIG. 2 is a perspective view illustrating a state in which a side cover disposed on an apparatus body case of the printer is opened.

FIG. 2 is a perspective view illustrating a state in which a side cover 24 disposed on apparatus body case 2 is opened. In the color printer 1 according to the exemplary embodiment, when the side cover 24 is opened as illustrated in FIG. 2, the printer engine 3 and the waste toner container 7 appear. In this state, the process cartridge 23, the intermediate transfer belt 13, and the waste toner container 7 can be replaced, and other maintenance work can be performed. The cleaning device 11, the drive roller 16, the inlet roller 17, the tension roller 18, and the cleaning device 15 are stored inside a belt case 13*a* and formed as a unit.

Figure 3:
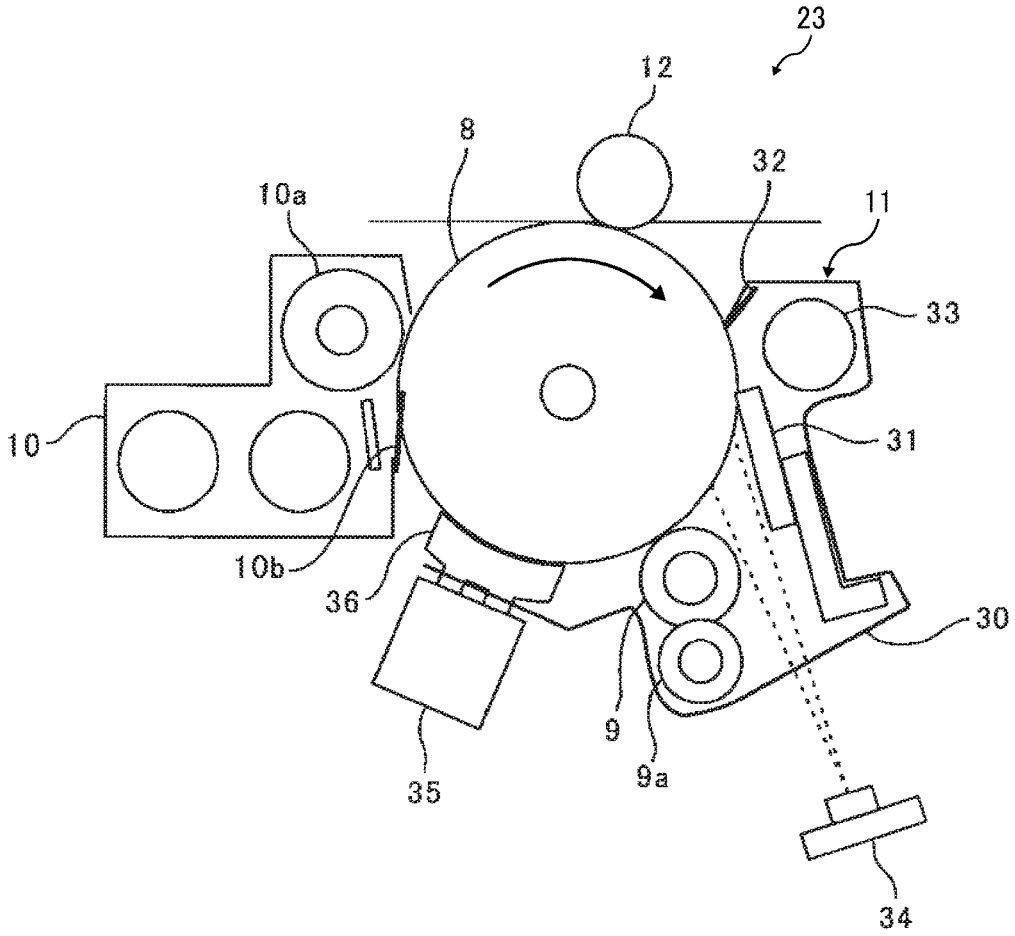
FIG. 3 is a sectional view illustrating a configuration on the periphery of a photoconductor of the printer.

Next, the process cartridge 23 of the exemplary embodiment is described. FIG. 3 is a sectional view illustrating one example of a configuration on the periphery of the photoconductor 8 of the color printer 1. As illustrated in FIG. 3, the process cartridge 23 includes the photoconductor 8 as an image bearer, a cleaning blade 31 (a cleaner), a scattering prevention sheet 32, and a powder conveyance coil 33. The cleaning blade 31 removes, for example, residual toner remaining on the photoconductor 8. The scattering prevention sheet 32 prevents scattering of the residual toner scraped off by the cleaning blade 31. The powder conveyance coil 33 conveys the residual toner, for example. Moreover, the process cartridge 23 includes a discharge lamp 34, the charging roller 9, a charging cleaner roller 9*a*, and an LED head 35 as an exposure device of the optical writing device 4 for forming a latent image on the photoconductor 8, and an LED spacer 36. The discharge lamp 34 discharges a residual charge of the photoconductor 8. The charging cleaner roller 9*a* cleans a surface of the charging roller 9. The LED spacer 36 as an adjuster regulates a distance between the LED head 35 and the photoconductor 8. Each of the components of the process cartridge 23 is directly or indirectly held by a frame 30 of the process cartridge 23.

Moreover, the developing device 10 is disposed on the periphery of the photoconductor 8. The developing device 10 includes a developing roller 10*a* and a scattering prevention member 10*b*. The developing roller 10*a* supplies developer to the photoconductor 8, and the scattering prevention member 10*b* prevents the developer from being scattered from the developing device 10.

Next, positioning of the LED head 35 is described. In the color printer 1 as an image forming apparatus of the exemplary embodiment, the LED head 35 is positioned on the photoconductor 8 via the LED spacer 36. The LED spacer 36 includes resin such as polyacetal (POM) having a slide property, so that abrasion due to slide of the LED spacer 36 against the photoconductor 8 can be minimized. Moreover, the LED spacer 36 is pressed toward the photoconductor 8. With such pressure, the photoconductor 8 and the LED spacer 36 closely contact each other. Hence, a position of each of the LED head 35 and the photoconductor 8 is determined with high accuracy. Moreover, a curvature of a contact surface between the LED head 35 and a surface of the photoconductor 8 may be set to be smaller than a curvature of the surface of the photoconductor 8. Accordingly, toner can be prevented from intruding between the LED spacer 36 and the photoconductor 8. Moreover, a position of the LED head 35 can be more adjacent to the photoconductor 8 than a position of an LED head in a laser diode (LD) raster system in which a laser beam is scanned by a polygon to irradiate a photoconductor with the laser beam. Thus, size of an apparatus body of the color printer 1 can be reduced.

According to the exemplary embodiment, the color printer 1 employs a two-component development as a development method of the developing device 10. The two-component development uses developer containing toner and carrier. Since the two-component development has lower stress than a one-component development, the developing device 10 can have a longer lifespan. A developing device using two-component developer supplies the developer to a surface of a developing roller by using a magnetic force of a magnet inside the developing roller while mixing and stirring toner and carrier in the developer. With rotation of the developing roller, the developer is conveyed to a developing area opposite a latent image bearer such as a photoconductor. After the toner is selectively transferred to a latent image on the latent image bearer in the developing area, the toner returns to the developing device. Herein, the carrier may attach to the photoconductor due to an electrostatic force or a centrifugal force provided by rotation of the developing roller. Moreover, the developer inside the developing device may be leaked from a portion such as a joint of sealing members although the developer is sealed inside a developing case. In such a case, the developer can drift inside the printer.

Carrier adhering to the photoconductor or most of carrier drifting inside the printer can be collected by a cleaning device and then stored in a container, or flow by airflow inside the printer and then be captured by a filter disposed in an airflow path through which the air is emitted outside. However, there is a possibility that one portion of the carrier adhering to the photoconductor or one portion of the scattered carrier may intrude into a contact portion between an LED spacer and the photoconductor. Since the carrier is iron powder, abrasion of the photoconductor and the LED spacer is accelerated even if a small amount of the carrier intrudes into the contact portion between the LED spacer and the photoconductor. Moreover, since the LED head has a short focal length, any change in a distance between the LED head and the photoconductor causes an irregular image such as a decrease in resolution and fluctuations in density. Accordingly, a distance between the LED head and the photoconductor needs to be determined with high accuracy.

Figure 4:
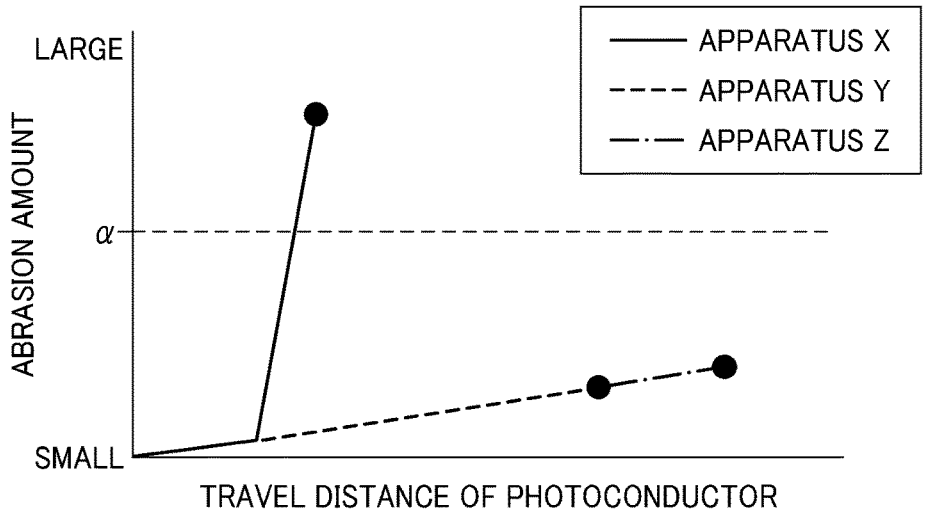
FIG. 4 is a graph illustrating a relation between a travel distance of the photoconductor and an abrasion amount of the photoconductor.

FIG. 4 is a graph illustrating a relation between a travel distance of a photoconductor and an abrasion amount of the photoconductor and an LED spacer. In the graph illustrated in FIG. 4, an apparatus X indicated by a solid line represents a related-art image forming apparatus employing a two-component development as a development method, and an apparatus Y indicated by a dotted line represents a related-art image forming apparatus employing a one-component development as a development method. An apparatus Z indicated by a dashed line represents an image forming apparatus employing a two-component development as a development method according to the exemplary embodiment. Even if an LED spacer is pressed against a photoconductor, there is a clearance between the LED spacer and the photoconductor since the LED spacer and the photoconductor are solid objects. In a case where carrier intrudes into the clearance, the photoconductor and the LED spacer are abraded with an increase in a travel distance of the photoconductor as illustrated in FIG. 4.

In FIG. 4, intrusion of the carrier between the photoconductor and the LED spacer causes abrasion speed in the apparatus X to be higher than abrasion speed in the apparatus Y. On the other hand, abrasion speed in the apparatus X as the image forming apparatus of the exemplary embodiment is substantially the same as the abrasion speed in the apparatus Y employing the one-component development as the development method. If an abrasion amount of the photoconductor and the LED spacer becomes a predetermined tolerance a or greater, the abrasion amount is determined to be greater than or equal to an amount at which a change in a position can be tolerated. Consequently, an irregular image such as a decrease in resolution and fluctuation in density is generated.

Figure 5:
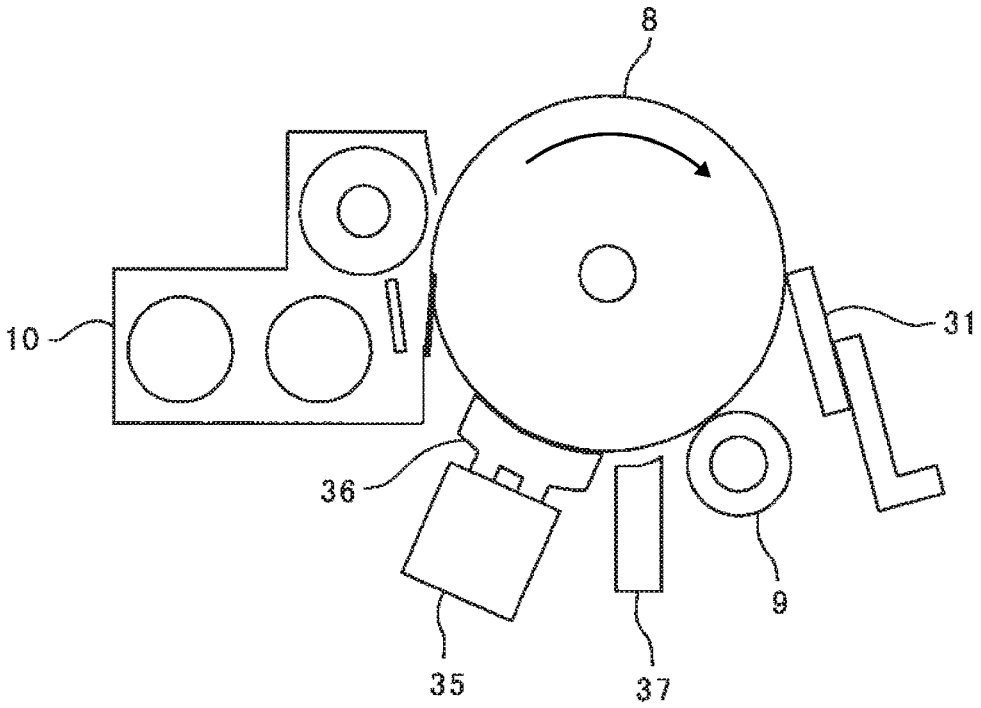
FIG. 5 is a schematic diagram illustrating one example of a magnetic member of a process unit.
Figure 6:
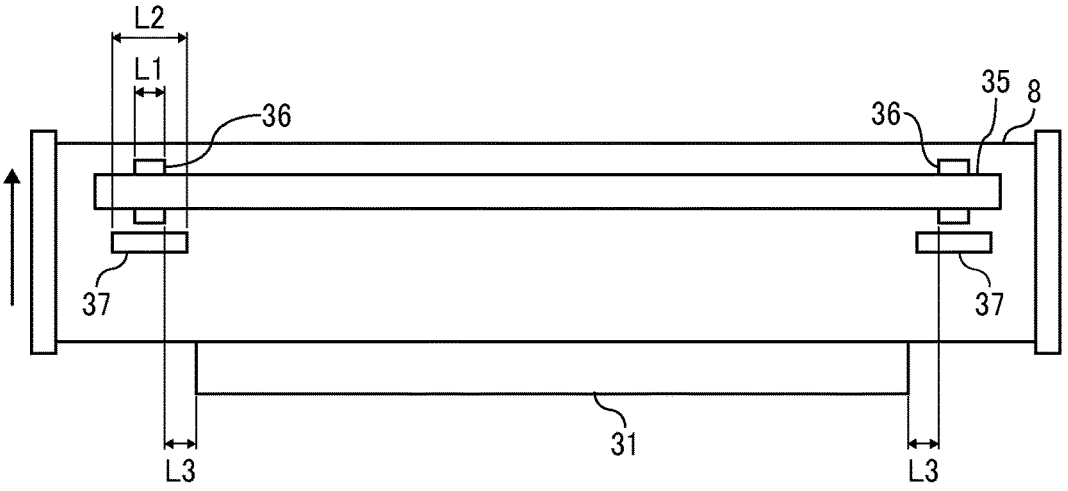
FIG. 6 is a diagram illustrating arrangement of the magnetic member of the process unit.

FIG. 5 is a schematic diagram illustrating one example of a magnetic member 37 of the process cartridge 23. FIG. 6 is a diagram illustrating arrangement of the magnetic member 37 of the process cartridge 23. As illustrated in FIG. 5, the color printer 1 as the image forming apparatus according to the exemplary embodiment includes the magnetic member 37 disposed on an upstream side of the LED spacer 36 in a rotation direction of the photoconductor 8. The magnetic member 37 is disposed in a non-contact manner with respect to a surface of the photoconductor 8. Moreover, as illustrated in FIG. 6, a position of the magnetic member 37 in a longitudinal direction of the photoconductor 8 is substantially the same as a position of the LED spacer 36. Thus, even if rotation of the photoconductor 8 causes carrier to adhere to a contact portion in which the LED spacer 36 contacts the surface of the photoconductor 8, the arrangement of the magnetic member 37 on the upstream side of the LED spacer 36 in the rotation direction of the photoconductor 8 enables the carrier to be removed from the surface of the photoconductor 8 by the magnetic member 37 before the carrier intrudes between the LED spacer 36 and the photoconductor 8.

Moreover, the arrangement of the magnetic member 37 in a non-contact manner with respect to the photoconductor 8 enables the magnetic member 37 to remove carrier from the surface of the photoconductor 8 without contacting the photoconductor 8. Accordingly, abrasion of the photoconductor due to contact made by a cleaner can be more prevented than a case in which carrier is removed by using a cleaner that contacts a surface of a photoconductor to remove foreign substances from the surface of the photoconductor.

When the carrier on the photoconductor is to be captured, a magnetic force allowing the capture of the carrier needs to be applied by the magnetic member. A strength of the magnetic force necessary for the capture of the carrier is determined based on a magnetic force of the magnetic member and a distance between the magnetic member and the photoconductor. The magnetic force of the magnetic member needs to be set in a range such that electronic equipment (e.g., a control circuit board inside an LED head) adjacent to the magnetic member does not malfunction. Thus, a clearance between the photoconductor and the magnetic member is preferably set as small as possible in a range in which the carrier captured by the magnetic member does not contact the photoconductor. Such setting can increase a magnetic force to be applied to the photoconductor even if a magnetic force of the magnetic force remains the same. Size of the clearance between the photoconductor and the magnetic member may be smaller than a carrier diameter. In such a case, the carrier captured by the magnetic member slides against the photoconductor, and the photoconductor is abraded. Hence, size of the clearance between the photoconductor and the magnetic member is preferably at least greater than or equal to a carrier diameter. In the color printer 1 of the exemplary embodiment, size of a clearance between the photoconductor 8 and the magnetic member 37 is not only at least greater than or equal to a carrier diameter but also smaller than or equal to size allowing the magnetic member 37 to capture carrier on the photoconductor 8 with a magnetic force.

Moreover, even if size of a clearance between a photoconductor and a magnetic member is greater than or equal to a carrier diameter, carrier captured by the magnetic member may be accumulated to an amount to contact the photoconductor. In such a case, the carrier can adhere to the photoconductor again. Since an amount of the carrier that has been captured by the magnetic member and then contacts the photoconductor differs depending on an image forming system, size of a clearance between the photoconductor and the magnetic member can be determined according to a carrier diameter, a required lifespan, and a degree of tendency of carrier adhesion to the photoconductor. Similarly, since a magnetic force necessary to capture carrier that has adhered to the photoconductor differs depending on an image forming system, the magnetic force can be determined according to a carrier diameter, a required lifespan, and a degree of tendency of carrier adhesion to the photoconductor.

The magnetic member 37 can include a fixed magnet constantly having a magnetic force or an electromagnet having a magnetic force that can be switched on and off. If the fixed magnet is used as the magnetic member 37, the fixed magnet is simply disposed within a desired size range of a clearance between the photoconductor 8 and the magnetic member 37 to capture carrier on the photoconductor 8. Thus, the configuration is simple. However, desired size of a clearance between the photoconductor 8 and the magnetic member 37 is not easily retained until the end of mechanical lifespan since there is a trade-off relation between a permissible amount of carrier to be captured by the magnetic member 37 and a strength of magnetic force to be applied to the photoconductor 8 by the magnetic member 37.

Accordingly, the fixed magnet is disposed as one component of the process cartridge 23, so that the magnetic member 37 with captured carrier can be replaced when the process cartridge 23 is replaced. Such a configuration reduces an accumulated amount of the carrier captured by the magnetic member 37. Hence, a clearance between the photoconductor 8 and the magnetic member 37 can be set to be smaller, the clearance being necessary to prevent re-adhesion of the captured carrier to the photoconductor 8.

Alternatively, the electromagnet may be used as the magnetic member 37. In such a case, although a base or a control operation is needed to supply electric power to the electromagnet, a magnetic force can be selectively switched on and off. The use of the electromagnet enables carrier to be captured from the photoconductor 8 when a magnetic force is switched on during the image formation, and carrier adhering to the electromagnet as the magnetic member 37 to be removed when a magnetic force is switched off at the stop or reverse of the photoconductor 8. For example, as illustrated in FIG. 5, if the magnetic member 37 is disposed below the photoconductor 8, carrier captured by the electromagnet is separated from the electromagnet and falls downward when a magnetic force of the electromagnet is switched off. Since the carrier captured by the electromagnet is not continuously accumulated, size of a clearance between the photoconductor 8 and the magnetic member 37 can be set to be even smaller.

Moreover, as illustrated in FIG. 6, the magnetic member 37 has a width L2 that is greater than or equal to a contact width L1 of the LED spacer 36. The magnetic member 37 is desirably disposed to cover a contact area of the LED spacer 36. The width L2 of the magnetic member 37 is provided in a rotation axis direction of the photoconductor 8 on a surface of the photoconductor 8, and the contact width L1 of the LED spacer 36 is provided in the rotation axis direction of the photoconductor 8. Such arrangement enables a magnetic force of the magnetic member 37 to be reliably applied to a slide width of the LED spacer 36 on the photoconductor 8, so that carrier on an upstream side of the LED spacer 36 in the rotation direction of the photoconductor 8 can be reliably captured.

Moreover, a contact portion of the LED spacer 36 with the photoconductor 8 is desirably provided in an area in which any component is not in contact with a surface of the photoconductor 8 in a longitudinal direction of the photoconductor 8. Particularly, in the image forming apparatus illustrated in FIG. 6, the LED spacer 36 is disposed outward by only a distance L3 in the longitudinal direction of the photoconductor 8 relative to the cleaning blade 31. Accordingly, abrasion of the photoconductor 8 by the cleaning blade 31 can reduce fluctuations in position of the LED head 35 due to abrasion of the photoconductor 8 and the LED spacer 36 caused by slide of the LED spacer 36.

In such a configuration, the cleaning blade 31 is not disposed with respect to the contact portion between the photoconductor 8 and the LED spacer 36 in the rotation direction of the photoconductor 8. Consequently, the cleaning blade 31 cannot remove the carrier which is adhering to the photoconductor 8 and is to be conveyed between the LED spacer 36 and the photoconductor 8. However, since the magnetic member 37 is disposed on an upstream side of the LED spacer 36 in the rotation direction of the photoconductor 8, the carrier on the photoconductor 8 can be captured by the magnetic member 37 before the carrier intrudes between the LED spacer 36 and the photoconductor 8.

Figure 7:
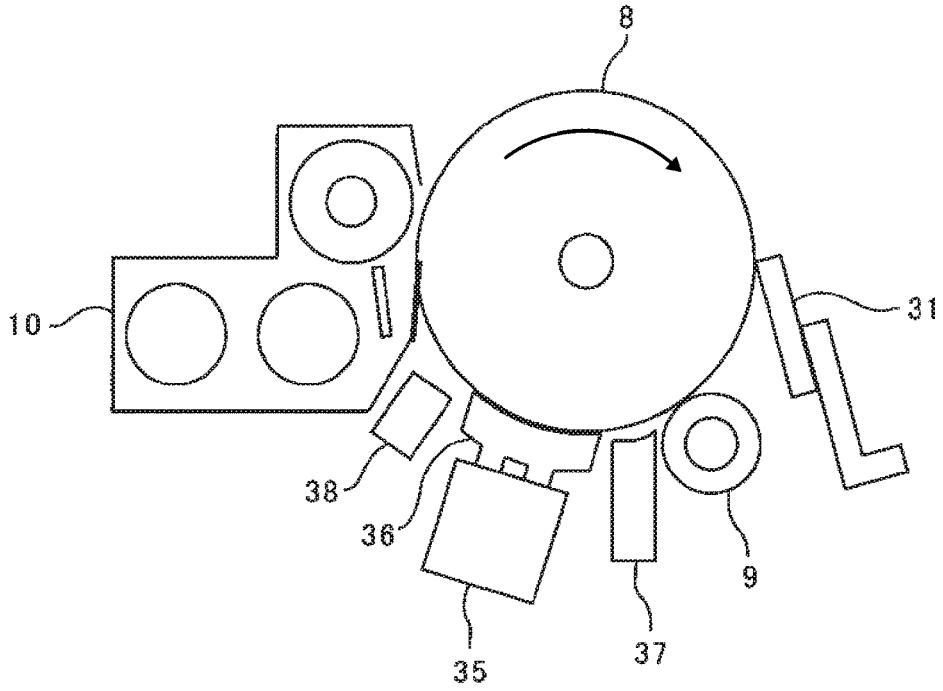
FIG. 7 is a schematic diagram illustrating one example of a configuration in which two magnetic members are arranged in the process unit.

FIG. 7 is a schematic diagram illustrating one example of a configuration in which two magnetic members are arranged in the process cartridge 23. As illustrated in FIG. 7, for example, a second magnetic member 38 is disposed between the LED spacer 36 and the developing device 10 in the rotation direction of the photoconductor 8. The second magnetic member 38 can capture carrier scattered from the developing device 10. Therefore, the scattered carrier from the developing device 10 can be captured before adhering to an impulse unit on the photoconductor 8. The impulse unit contacts the LED spacer 36 to generate an impulse. Thus, an amount of the carrier to be captured by a first magnetic member 37 disposed on the upstream side of the LED spacer 36 in the rotation direction of the photoconductor 8 can be reduced, and a clearance between the photoconductor 8 and the first magnetic member 37 can be narrower. Moreover, such arrangement can prevent re-adhesion of the captured carrier to the photoconductor 8 over time due to accumulation of the captured carrier on the first magnetic member 37.

Figure 8:
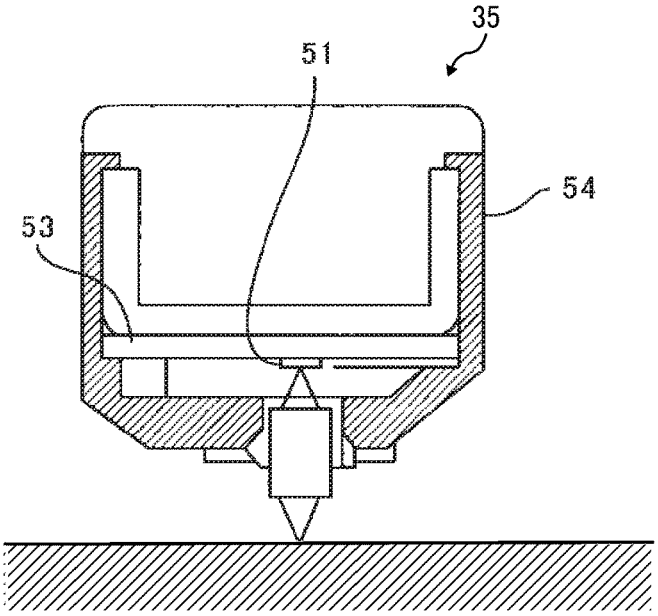
FIG. 8 is a sectional view illustrating one example of a light emitting diode (LED) head of the process unit.

FIG. 8 is a sectional view illustrating one example of the LED head 35 of the process cartridge 23. As illustrated in FIG. 8, the LED head 35 includes an LED array chip 51, a board 53, and a case 54. The LED array chip 51 is mounted on the board 53. On the board 53, a control board for controlling emission of LED and a memory for retaining write information are mounted. In the color printer 1 of the exemplary embodiment, the magnetic member 37 is disposed adjacent to the LED head 35. In such a case, a magnetic force of the magnetic member 37 may cause the control board and the memory of the LED head 35 to malfunction. In particular, with recent speed enhancement, a magnetic member having a stronger magnetic force needs to be used to capture carrier adhering to a photoconductor. Moreover, with reduction in size of an image forming apparatus, a magnetic member and an LED head are arranged more adjacent to each other, and such arrangement increases the risk of malfunction of an LED due to a magnetic force of the magnetic member.

Moreover, a magnetic force allowing capture of the carrier can be provided in a contact portion between the LED spacer 36 and the photoconductor 8, so that the carrier drifting inside the printer 1 is prevented from intruding between the magnetic member 37 and the LED spacer 36 in the rotation direction of the photoconductor 8. However, in a case where the magnetic member 37 having a strong magnetic force is disposed adjacent to the LED head 35, the LED head 35 may malfunction due to the magnetic force as described above.

Figure 9:
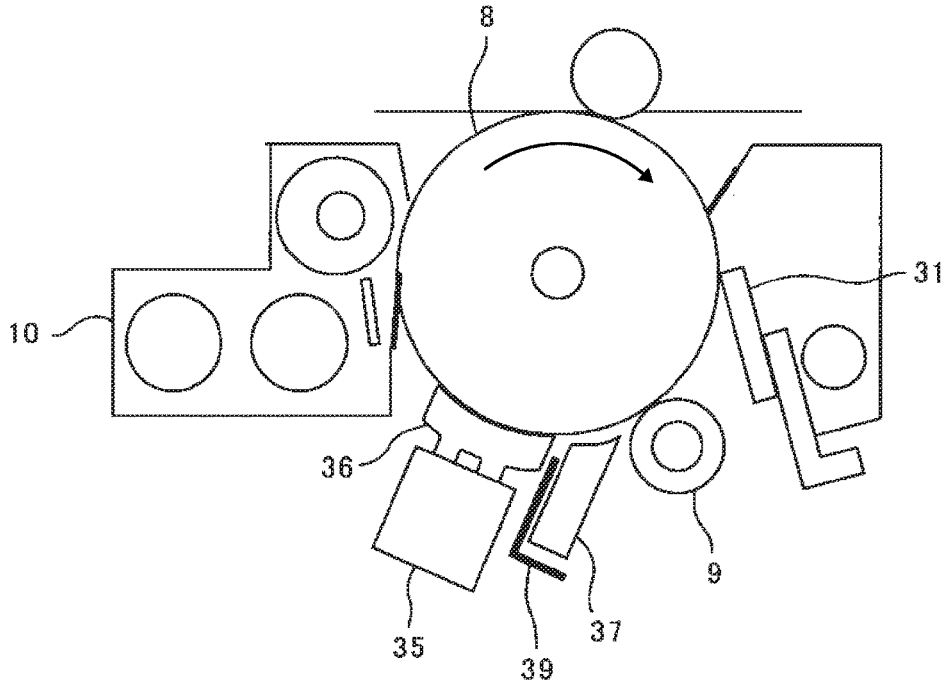
FIG. 9 is a diagram illustrating one example of a configuration in which a magnetic shield is disposed in the process unit.

FIG. 9 is a diagram illustrating one example of a configuration in which a magnetic shield 39 is disposed in the process cartridge 23. As illustrated in FIG. 9, the magnetic shield 39 as a magnetic force controller can be disposed between the magnetic member 37 and the LED head 35. The magnetic shield 39 renders a magnetic force to be received by the LED head 35 from the magnetic member 37 and a magnetic force to be received by the LED spacer 36 different from each other. The magnetic shield 39 can reduce influence of the magnetic force of the magnetic member 37 with respect to the board of the LED head 35. Hence, even if the magnetic member 37 having a stronger magnetic force is positioned adjacent to the LED head 35, a malfunction of the LED head 35 due to magnetism of the magnetic member 37 can be prevented. Thus, the magnetic member 37 can apply an adequate magnetic force to the contact portion between the LED spacer 36 and the photoconductor 8. Therefore, the carrier can be captured before intruding between the photoconductor 8 and the LED spacer 36 while influence of the magnetic force with respect to the LED head 35 is being reduced.

The magnetic shield 39 can be made of a material having a magnetic property. The stronger the magnetic force, the greater the shielding effect. The magnetic shield 39 is desirably made of iron since iron not only has a magnetic property but also is good from cost and processability standpoints. Moreover, a component disposed between the magnetic member 37 and the LED head 35, for example, the case 54 of the LED head 35, out of components of the LED head 35 can be made of a material having a magnetic shielding effect.

Figure 10:
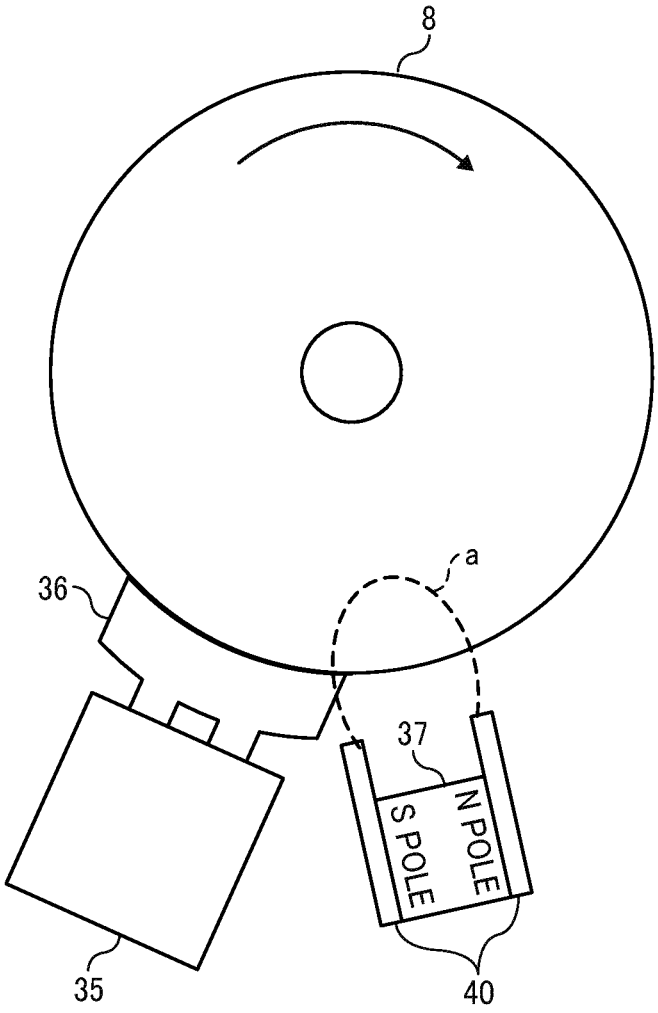
FIG. 10 is a schematic diagram illustrating one example of a configuration in which a yoke is disposed in the magnetic member.

FIG. 10 is a schematic diagram illustrating one example of a configuration in which a yoke 40 is disposed in the magnetic member 37. As illustrated in FIG. 10, the yoke 40 can be used to control a magnetic line of force "a". The use of the yoke 40 can centralize a magnetic force toward the photoconductor 8, strengthens the magnetic force with respect to carrier adhering to the photoconductor 8, and weakens the magnetic force toward the LED head 35.

The above description is merely one example, and the following effects described in respective aspects can be provided.

(Aspect A) An image forming apparatus such as a color printer 1 includes a rotatable image bearer such as a photoconductor 8, an exposure device such as a LED head 35, a developing unit such as a developing device 10, an adjuster such as a LED spacer 36, and a magnetic member such as a magnetic member 37. The exposure device forms a latent image on a surface of the image bearer. The developing unit renders the latent image visible. The adjuster contacts each of the image bearer and the exposure device to regulate a distance between the image bearer and the exposure device. The magnetic member is arranged side by side with the adjuster in a direction of rotation of the image bearer. In the image forming apparatus, the developing unit uses developer containing toner and carrier.

Although a developing unit employing a two-component development can have a longer lifespan than a developing unit employing a one-component development, abrasion of an image bearer or an adjuster can be accelerated by the following reasons. That is, in a related-art image forming apparatus, since an adjuster is in contact with an image bearer, the adjuster and the image bearer are abraded. Such abrasion causes degradation in positional accuracy over time. Each of the components is abraded by simply making a sliding movement. Moreover, intrusion of foreign substances between the adjuster and the image bearer causes the abrasion to become more significant. If a two-component development is employed as a development method, carrier having iron as a main component is used. Since such carrier is harder than the image bearer and the adjuster, intrusion of the carrier between the adjuster and the image bearer can accelerate abrasion of the image bearer and the adjuster.

In the aspect A, the carrier adhering to a surface of the image bearer can be captured by the magnetic member arranged side by side with the adjuster in a direction of rotation of the image bearer as described in the above exemplary embodiment. Such a configuration can prevent intrusion of the carrier between the adjuster and the image bearer, thereby suppressing acceleration of abrasion of the adjuster and the image bearer due to the intrusion of the carrier. Therefore, even if developer containing toner and carrier is used, a position of the exposure device can be maintained over time with high accuracy, and the image forming apparatus, which does not generate an irregular image, can be provided.

(Aspect B) In the image forming apparatus with the aspect A, the magnetic member such as the magnetic member 37 is disposed in a non-contact manner with respect to the image bearer such as the photoconductor 8.

In the aspect B, since the magnetic member is disposed in a non-contact manner with respect to the photoconductor, the magnetic member can remove the carrier adhering to the surface of the photoconductor without contacting the image bearer as described in the above exemplary embodiment. Therefore, abrasion of the image bearer caused by friction with the magnetic member can be suppressed.

(Aspect C) In the image forming apparatus with the aspect B, the magnetic member as the magnetic member 37 is disposed not only on an upstream side of the adjuster in the direction of rotation of the image bearer, but also adjacent to a surface of the image bearer such as the photoconductor 8.

In the aspect C, since the magnetic member is disposed not only on an upstream side of the adjuster in the direction of rotation of the image bearer, but also adjacent to a surface of the image bearer, carrier adhering to a slide portion with the adjuster on the image bearer can be captured by the magnetic member before intruding between the adjuster and the image bearer, as described in the above exemplary embodiment.

(Aspect D) In the image forming apparatus with the aspect A or B, the magnetic members such as the magnetic members 37 and 38 are respectively disposed on an upstream side and a downstream side of the adjuster such as the LED spacer 36 in the direction of rotation.

Accordingly, a clearance between the image bearer and the magnetic member can be set to be smaller as described in the above exemplary embodiment. Thus, a magnetic force of the magnetic member can be minimized. Such arrangement can prevent a malfunction of electric equipment adjacent to the magnetic member due to the magnetic force of the magnetic member.

(Aspect E) In the image forming apparatus with any of the aspects A through D, the magnetic member such as the magnetic member 37 has a width greater than a width of the adjuster such as the LED spacer 36 in a rotation axis direction of the image bearer such as the photoconductor 8. Since such arrangement enables the magnetic member to capture carrier in the entire slide portion of the image bearer with the adjuster, the carrier can be reliably captured as described in the above exemplary embodiment.

(Aspect F) The image forming apparatus with any of the aspects A through E includes a cleaner such as a cleaning blade 31 for removing adherents from a surface of the image bearer such as the photoconductor 8, and the adjuster such as the LED spacer 36 is disposed outside the cleaner in an axial direction of the image bearer. Accordingly, as described in the above exemplary embodiment, fluctuations in position of the adjuster due to abrasion of the image bearer and the adjuster caused by slide can be reduced by abrasion of the image bearer due to slide with the cleaner.

(Aspect G) The image forming apparatus with any of the aspects A through E includes a magnetic force controller such as a magnetic shield 39. The magnetic force controller renders a magnetic force to be received by the exposure device such as the LED head 35 from the magnetic member such as the magnetic member 37 and a magnetic force to be received by the adjuster such as the LED spacer 36 different from each other. The exposure device includes a control board that is integrally retained, and the magnetic member is disposed adjacent to the adjuster.

In the aspect G, the image forming apparatus includes the magnetic force controller which renders a magnetic force to be received by the exposure device from the magnetic member and a magnetic force to be received by the adjuster different from each other as described in the above exemplary embodiment. Thus, the use of the magnetic force controller can reduce influence of the magnetic force of the magnetic member with respect to the control board of the exposure device. Thus, even if the magnetic member having a strong magnetic force is disposed adjacent to the adjuster, the exposure device does not tend to be affected by magnetism of the magnetic member. Therefore, even if a strength of magnetic force of the magnetic member is set such that intrusion of the carrier between the adjuster and the image bearer is reliably suppressed, the exposure device can be prevented from malfunctioning due to the magnetic force of the magnetic member.

(Aspect H) A process cartridge is used in an image forming apparatus including a rotatable image bearer, an exposure device, a developing unit, an adjuster, and a magnetic member. The exposure device forms a latent image on a surface of the image bearer. The developing unit renders the latent image visible. The adjuster contacts each of the image bearer and the exposure device to regulate a distance between the image bearer and the exposure device. The magnetic member is arranged side by side with the adjuster in a direction of rotation of the image bearer. The process cartridge includes at least the image bearer and the magnetic member as a single unit, and is detachable from the image forming apparatus.

Accordingly, the image bearing member and the magnetic member with captured carrier can be replaced at a time. As described in the above exemplary embodiment, since an amount of accumulated carrier to be captured by one magnetic member can be reduced, a clearance between the image bearer and the magnetic member can be set to be smaller, and a magnetic force of the magnetic member can be minimized.

(Aspect I) The image forming apparatus with any of the aspects A through G includes the process cartridge with the aspect H. Therefore, size of the image forming apparatus can be reduced and the lifespan of the image forming apparatus can be prolonged.

The present disclosure has been described above with reference to specific exemplary embodiments but is not limited thereto. Various modifications and enhancements are possible without departing from scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. An image forming apparatus, comprising:

a rotatable image bearer;

an exposure device external to the image bearer and configured to form a latent image on an external surface of the image bearer from an exterior of the image bearer;

a developing device configured to render the latent image visible;

an adjuster configured to contact each of the external surface of the image bearer and the exposure device to regulate a distance between the image bearer and the exposure device; and a magnetic member arranged side by side with the adjuster in a direction of rotation of the image bearer, the magnetic member on an upstream side of the adjuster in the direction of rotation, the magnetic member adjacent to the external surface of the image bearer, the magnetic member isolated from contact with the image bearer.

2. The image forming apparatus according to claim 1, further comprising:

a plurality of magnetic members, the plurality of magnetic members including the magnetic member, wherein the magnetic members are on each of the upstream side and a downstream side of the adjuster in the direction of rotation.

3. The image forming apparatus according to claim 1, wherein the magnetic member has a width greater than a width of the adjuster in a rotation axis direction of the image bearer.

4. The image forming apparatus according to claim 1, further comprising:

a cleaner configured to remove adherents from a surface of the image bearer, wherein the adjuster is outside the cleaner in an axial direction of the image bearer.

5. The image forming apparatus according to claim 1, further comprising:

a magnetic force controller configured to render a magnetic force to be received by the exposure device from the magnetic member and a magnetic force to be received by the adjuster different from each other, wherein the exposure device includes a control board that is integrally retained, and wherein the magnetic member is adjacent to the adjuster.

6. The image forming apparatus according to claim 5, wherein the magnetic force controller is a magnetic shield between the magnetic member and the exposure device.

7. The image forming apparatus according to claim 1, wherein the magnetic member is a fixed magnet.

8. A process cartridge usable in an image forming apparatus, the image forming apparatus comprising:

a rotatable image bearer;

an exposure device configured to form a latent image on a surface of the image bearer;

a developing device configured to render the latent image visible;

an adjuster configured to contact each of the image bearer and the exposure device to regulate a distance between the image bearer and the exposure device; and a magnetic member arranged side by side with the adjuster in a direction of rotation of the image bearer, the magnetic member isolated from contact with the image bearer, the process cartridge including at least the image bearer and the magnetic member as a single unit and detachable from the image forming apparatus.

9. The process cartridge according to claim 8, the image forming apparatus further including a magnetic force controller configured to render a magnetic force to be received by the exposure device from the magnetic member and a magnetic force to be received by the adjuster different from each other, wherein the exposure device includes a control board that is integrally retained, and wherein the magnetic member is adjacent to the adjuster.

10. The process cartridge according to claim 9, wherein the magnetic force controller is a magnetic shield between the magnetic member and the exposure device.

11. The process cartridge according to claim 8, wherein the magnetic member is on an upstream side of the adjuster in the direction of rotation, and the magnetic member is adjacent to a surface of the image bearer.

12. The process cartridge according to claim 8, wherein the magnetic member is on an upstream side of the adjuster in the direction of rotation, and the magnetic member is adjacent to a surface of the image bearer.

13. An image forming apparatus, comprising:

a rotatable image bearer;

an exposure device configured to form a latent image on a surface of the image bearer;

a developing device configured to render the latent image visible;

an adjuster configured to contact each of the image bearer and the exposure device to regulate a distance between the image bearer and the exposure device; and a magnetic member arranged side by side with the adjuster in a direction of rotation of the image bearer, the magnetic member isolated from contact with the image bearer, a process cartridge retaining at least the image bearer and the magnetic member as a single unit and detachable from the image forming apparatus.

14. The image forming apparatus according to claim 13, wherein the magnetic member is on an upstream side of the adjuster in the direction of rotation, and the magnetic member is adjacent to a surface of the image bearer.

15. The image forming apparatus according to claim 13, the image forming apparatus further including a plurality of magnetic members, the plurality of magnetic members including the magnetic member, wherein the magnetic members are on each of an upstream side and a downstream side of the adjuster in the direction of rotation.

16. The image forming apparatus according to claim 13, wherein the magnetic member has a width greater than a width of the adjuster in a rotation axis direction of the image bearer.

17. The image forming apparatus according to claim 13, the image forming apparatus further including a cleaner configured to remove adherents from a surface of the image bearer, wherein the adjuster is outside the cleaner in an axial direction of the image bearer.

18. The image forming apparatus according to claim 13, the image forming apparatus further including a magnetic force controller configured to render a magnetic force to be received by the exposure device from the magnetic member and a magnetic force to be received by the adjuster different from each other, wherein the exposure device includes a control board that is integrally retained, and wherein the magnetic member is adjacent to the adjuster.

19. The image forming apparatus according to claim 18, wherein the magnetic force controller is a magnetic shield between the magnetic member and the exposure device.

20. The image forming apparatus according to claim 13, wherein the magnetic member is a fixed magnet.

* * * * *